United States Patent [19]

Haneda et al.

[11] 4,202,192

[45] May 13, 1980

[54] APPARATUS FOR CONTROLLING THE POSITION OF ROLL IN THE DIRECTION OF THE ROLL AXIS

[75] Inventors: Yoshikazu Haneda; Yoshun Yamamoto; Akira Matsufuji; Takashi Haji, all of Kitakyushu; Koe Nakajima, Nakama, all of Japan

[73] Assignee: Nippon Steel Corporation, Tokyo, Japan

[21] Appl. No.: 917,650

[22] Filed: Jun. 21, 1978

[51] Int. Cl.[2] ..... B21B 37/00; B21B 31/18

[52] U.S. Cl. ..... 72/21; 72/247; 72/244

[58] Field of Search ..... 72/247, 21, 237

[56] References Cited

U.S. PATENT DOCUMENTS

| | | | |
|---|---|---|---|
| 2,356,783 | 8/1944 | Notzke | 72/247 X |
| 3,055,242 | 9/1962 | Wilson | 72/247 |
| 3,901,059 | 8/1975 | Nakajima et al. | 72/245 |
| 3,973,425 | 8/1976 | Woodrow | 72/247 |
| 4,059,794 | 11/1977 | Furness et al. | 72/247 X |

*Primary Examiner*—Milton S. Mehr

*Attorney, Agent, or Firm*—Wenderoth, Lind & Ponack

[57] ABSTRACT

An apparatus for controlling axial positions of rolls of a rolling mill to obtain and maintain desired axial rigidity of the rolls. Pre-stress, the axial load and the axial position of each roll are detected. The detected signals are processed to determine the axial positions of the rolls to achieve the desired rigidity.

6 Claims, 14 Drawing Figures

APPARATUS FOR CONTROLLING THE POSITION OF ROLL IN THE DIRECTION OF THE ROLL AXIS

DETAILED DESCRIPTION OF THE INVENTION

This invention relates to an apparatus for controlling the position of a roll in the axial direction thereof during rolling of a material.

The cross-sectional configurations of metallic section members such as angles are not simply rectangular nor of uniform width as with ordinary plates but are diversified in width and thickness. The rolling of such a metallic section members has been carried out by the use of a plurality of rolls forming a complicated roll-pass contour. Therefore, in order to obtain a predetermined or desired cross-sectional configuration, it is necessary to properly control not only the position in the radial direction (the direction of reduction) of the rolls but also the position in the axial direction of the rolls, which are hereinafter referred to as "position in the radial direction" and "position in the axial direction", respectively, and thereby to adjust the roll-pass contour formed by the rolls to a proper dimension and shape. Accordingly, the control or adjustment of the roll position in rolling such a section member becomes much more complicated than that in rolling plates whereby only the position in the radial direction of the rolls need be controlled.

On the other hand, in general a rolling mill is constituted such that the radial element of the rolling load generated during a rolling operation is taken up by the mill housing via the rolls, the bearings for the rolls, the roll chocks and the means for adjusting the roll position in the radial direction, etc., and the axial element (thrust) thereof is taken up by the mill housing via the rolls, the bearing for the rolls, the roll chocks and the means for adjusting the roll position in the axial direction (which is hereinafter referred to as "an axial-adjusting means"), etc. or it is taken up by the engagement of the thrust collars of the opposed rolls. Each of the above members is made of an elastic material (an elastically plastic body, as the case may be) and, therefore, the relation between the rolling reaction and the amount of deviation the roll gap can be defined by a particular function relating to each of the radial and axial directions of the roll (in general, the relation can be closely be compared with a proportional relation having a particular spring constant which in practice is the so-called mill rigidity). In addition there are the clearances of the bearings, the plays of the means for adjusting the roll position in the radial direction or the axial-adjusting means (for example, backlashes of screws and wheels employed therein) and/or such play as blacklash of the thrust collars in a rolling mill. It is well known that, if there are deviations of the dimension or shape of the material to be rolled and deviations of temperature such as skid mark and thermal rundown at the inlet of the rolling mill, deviation of the rolling load takes place whereby the roll gap is caused to deviate in the radial and axial directions in an amount which is the total of the deformations of the members constituting the rolling mill and the plays thereof in accordance with the aforesaid particular relation, which causes deviation of the dimension and shape of the material at the outlet of the mill.

Furthermore, it is known that, in rolling nonsymmetrical members such as angles with unequal legs and thickness if the proportion of the reduction of the flange to that of the web is improper, an unbalance between the stretching of the flange and the web is caused so that bends of the material occur. Accordingly, it is readily understood that, for example, as shown in FIG. 1, in order to roll an angle with unequal legs and thickness properly without the occurrence of bends in a two roll-type rolling mill even if the above-mentioned deviation of the rolling load takes place, the proportion of the roll gap deviation in the radial direction to that in the axial direction at the time of the deviation of the rolling load, i.e., $\Delta ht/\Delta hr$ in FIG. 1, must be kept at a proper value since the proportion of the reduction of the flange to that of the web must be kept constant even if the rolling load is changed. That is, it is noted that the rolling of a material can be conducted without bending by properly setting the proportion of the mill rigidity in the radial direction of the roll to that in the axial direction thereof. However, the proper relation of the mill rigidities varies depending upon the difference in roll-pass contour of rolls since it is inherent in the dimension and shape of the roll-pass contour. Consequently, where various kinds of materials are rolled by the same rolling mill, it becomes necessary to make the relation of the mill rigidities variable in an ordinary rolling mill.

Thus, it is very important to properly control the roll gaps in the radial and axial directions, namely to adjust the mill rigidity in the radial direction and that in the axial direction to proper values, in order to effect an excellent rolling without bending, i.e. to obtain excellent dimensions and shape of a material by rolling.

Meanwhile, if it is considered that the rolling load is given to a material only in the radial direction, for example as the case of plate rolling, the direction of the rolling load is not changed, that is the rolling load of the upper roll is always imparted in the upward direction and that of the lower roll is always directed in the downward direction, even if the rolling load is somewhat changed. That is, as shown in FIG. 2(a), if the rolling load is plotted on the of ordinate and the amount of roll movement in the radial direction is plotted on the abscissa, the load point is always in the first quadrant and the curve of the mill rigidity is held in the region in which the curve can be regarded as a nearly straight line. Accordingly, it is relatively easy to control the mill rigidity and a control means such as the so-called AGC has been developed for this purpose.

However, when the rolling load is directed not only in the radial direction but also in the axial direction, for example in the case of rolling a material having complicated cross-sectional configurations such as angles, a means for controlling the mill rigidity in the direction of the roll axis has not been developed and the control in the axial direction has been conducted only by the method of using the aforesaid mechanical axial-adjusting means or a thrust collar system.

One of the former methods is, for example, disclosed in Japanese Utility Model Publication No. 25073/66 but in all of the former methods the mill rigidity in the axial direction is as low as about $\frac{1}{4}$ to $\frac{1}{8}$ of that in the radial direction. Therefore, there is the disadvantage that the deviations of dimension and shape can not be sufficiently suppressed by the former methods. In addition, there is the disadvantage that, when the direction of the rolling thrust is reversed, which can easily take place in rolling a symmetrical material where the direction of the rolling thrust is not constant, for example in universal rolling of H-shape steel, the roll is moved in the axial direction in an amount corresponding to the backlashes of the axial direction so that a deterioration of the dimension and shape of the rolled material is caused because of the clearances in the axial direction such as clearances of the bearings for the roll. Besides, the deterioration of the dimension and shape is further increased because the rolling is conducted under a condition such that the axial mill rigidity is held in a low range, as is clearly understood from the characteristic curve of the temporary axial rigidity of the roll shown in FIG. 2(b).

On the other hand, the thrust collar systems have often been applied to a two roll-type rolling apparatus and one example thereof is shown in FIG. 3. In the systems when the direction of the rolling thrust is kept constant as in the case of rolling of angles with unequal legs and thickness shown in FIG. 3(a), the mill rigidity in the axial direction is high but there is the disadvantage that the direction of the rolling thrust is not constant in a case such as the rolling of a symmetrical section steel material as shown in FIG. 3(b) and, when the direction of the rolling thrust is reversed, the roll is moved relatively in the axial direction by an amount of the thrust collar gap G, which results in a roll gap deviation in the axial direction and the deterioration of the dimensions and shape of the material. That is, in such systems the characteristics of the roll gap deviation in the axial direction are the same as when using the axial adjusting means shown in FIG. 2(b) and, when the direction of the rolling thrust is not constant such as when rolling a symmetrical material, the same problems as in the former methods are caused. Besides, in such systems there is the disadvantage that the thrust collar must be constituted such that it has a certain slope relative to the roll axis and, therefore, sliding friction occurs on the surface of the thrust collars due to the difference in turning velocity between the thrust collars of the upper roll and the lower roll and the thrust collar is worn, whereby a change of the axial roll gap is caused, which results in the deterioration of dimension and shape of the material being rolled and, in some cases, the occurrence of galling of the thrust collar. In this connection the wear of the thrust collar sometimes amounts to several millimeters. Furthermore, the thrust collar systems can not be applied to a universal rolling of an H-shape steel member or a rail since the thrust force is taken up by the engagement of the thrust collars of the opposed rolls.

In both the former methods and the latter systems the mill rigidity in the axial direction has not been variable and, therefore, even if it is desired to roll various kinds of section members by the use of the same rolling mill to obtain an excellent dimension and shape without bends, it has been impossible to give the desired axial mill rigidity to the rolling mill. On the other hand, methods and apparatus for controlling the roll gap in the radial direction on the basis of the radial rolling load which is constant in the load direction, namely controlling radial mill rigidity, are well known and some of them have been commercially applied to plate rolling. However, there have not been any methods and apparatus suitable for controlling the roll gap in the axial direction including the case in which the direction of the axial load, i.e. thrust, which occurs, for example, in rolling of a symmetrical material is not constant, that is, methods and apparatus for controlling mill rigidity in the direction of the roll axis.

It is, therefore, an object of this invention to overcome all the disadvantages as set forth above.

It is another object of this invention to provide an apparatus for controlling the position of the rolls of a rolling mill in the direction of the roll axis which is capable of rolling a metallic section member to an excellent dimension and shape without any bends.

According to this invention, there is provided an apparatus for controlling the position of at least one roll of a rolling mill in the direction of the roll axis which comprises at least two output means for moving the roll in the direction of the roll axis, output-detecting means for detecting the outputs of the respective output means, position-detecting means for detecting the position of the roll in the direction of the roll axis, a first arithmetic means for calculating the rolling thrust force, a second arithmetic means for calculating the amount of movement to be given to the roll in the axial direction in response to the output of the first arithmetic means, and an operating means for operating and controlling the output means while comparing the outputs of the arithmetic means with the output of the position-detecting means.

According to this invention the actuators of the respective output means can be provided in the bearing boxes of the roll.

According to this invention, the actuators of the respective output means can be provided between the bearing box of the roll and the housing of the rolling mill.

According to this invention, the actuators of the respective output means can be provided between the bearing box of the roll and a member arranged in the vicinity of the housing of the rolling mill.

According to this invention, said actuator can be a cylinder.

According to this invention, said actuator can consist of a cylinder and a wedge.

This invention is further described in detail below with reference to the accompanying drawings. In the drawings:

FIG. 1 is a sectional view showing the movement of rolls due to the rolling load caused by rolling an angle steel section.

FIGS. 2(a) and 2(b) are graphs showing the characteristics of axial mill rigidity and radial mill rigidity in a conventional apparatus.

FIGS. 3(a) and 3(b) are sectional views showing examples of a conventional thrust collar system.

Figure 1:
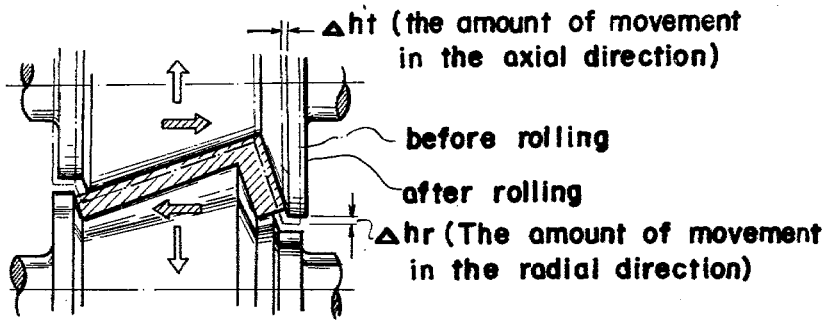
Figure 2A:
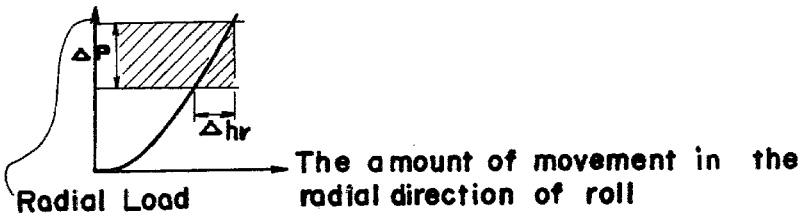
Figure 2B:
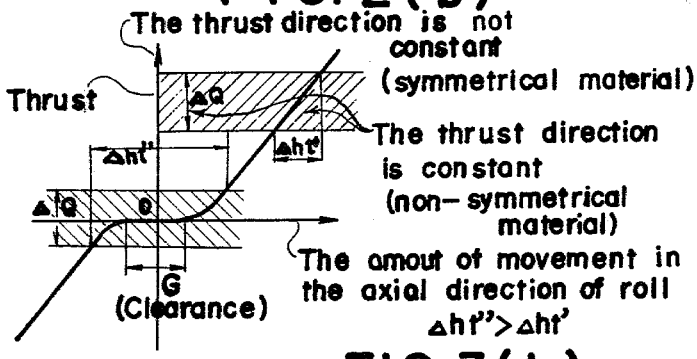
Figure 3A:
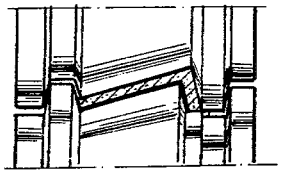
Figure 3B:
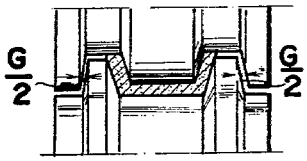
Figure 4:
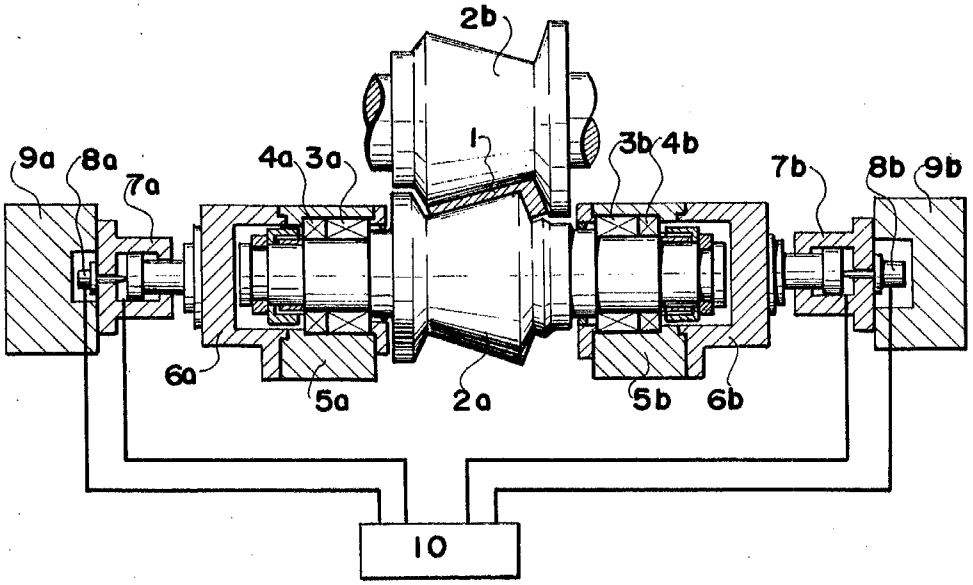
FIG. 4 is a partial sectional view including a block diagram which shows one preferred embodiment of this invention.

In the embodiment shown in FIG. 4, 1 is a metallic section member to be rolled and 2*a* and 2*b* are rolls, 3*a* and 3*b* being radial bearings for the roll 2*a*, 4*a* and 4*b* being thrust bearings for the roll 2a. In the embodiment the radial bearings and the thrust bearings are provided separately but the radial bearing 3a and the thrust bearing 4a and radial bearing 3b and thrust bearing 4b may respectively be replaced by common radial-thrust bearings 5a and 5b are bearing boxes and 6a and 6b are end covers, 7a and 7b being actuators of output devices for moving the roll 2a in the direction of the roll axis. In the embodiment the actuators are liquid pressure cylinders which are shown schematically but they are not limited to such cylinders. For example, each actuator may be constituted by a liquid pressure cylinder 7a and a movable wedge 11a, as shown in FIG. 5, and other equivalent devices can, of course, be employed as an actuator.

8a and 8b are position detectors for detecting the position of the roll 2a in the axial direction. In the embodiment, the position detectors 8a and 8b are arranged such that the detection of the position is made at the position of the rods of the liquid pressure cylinders 7a and 7b, but they may be positioned at any proper portion of the system constituted by the members existing between the roll-pass contour of the roll 2a and the liquid pressure cylinders 7a and 7b. In addition, any detector functioning to detect a position, for example a differential transformer, can be employed as the position detector 8a or 8b whether a contact type or a non-contact type. 9a and 9b are frames which are engaged with a housing (not shown), and the rolling thrust is born by the housing via the roll 2a, the thrust bearings 4a and 4b, the bearing boxes 5a and 5b, the end covers 6a and 6b, the actuators 7a and 7b, and the frames 9a and 9b. 10 is a control unit acting to receive the output load of the output devices 7a and 7b and the outputs of the position detectors 8a and 8b, etc. as input signals, to process the signals to calculate the amount of roll movement in the axial direction to be given to the roll and then to operate and control the actuators 7a and 7b so as to cause roll movement in the axial direction to correspond to the calculated amount. In the embodiment the actuators 7a and 7b are fixed to the frames 9a and 9b which are engaged with the housing but they may be fixed to the bearing boxes 5a and 5b or the end covers 6a and 6b.

Figure 5:
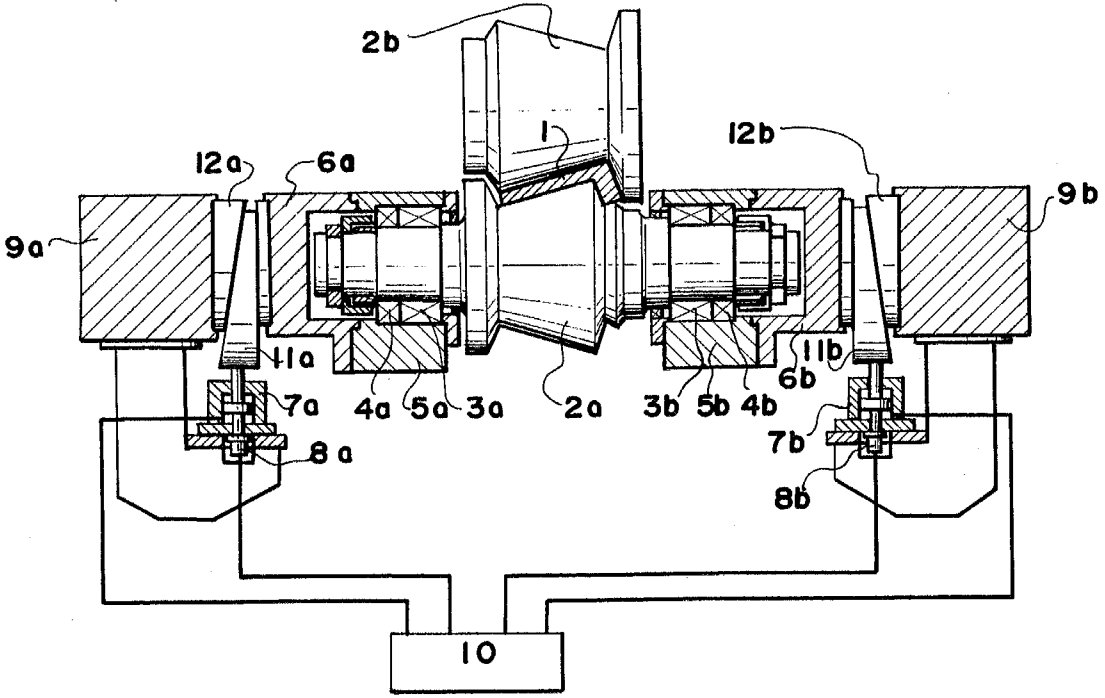
FIGS. 5 to 6 are sectional views including a block diagram which show other preferred embodiments of this invention.

FIG. 5 shows another embodiment of this invention in which the same reference numerals as those of FIG. 4 are assigned to the same members as those in FIG. 4 and reference numerals 11a and 11b designate movable wedges, 12a and 12b being fixed wedges.

Figure 6:
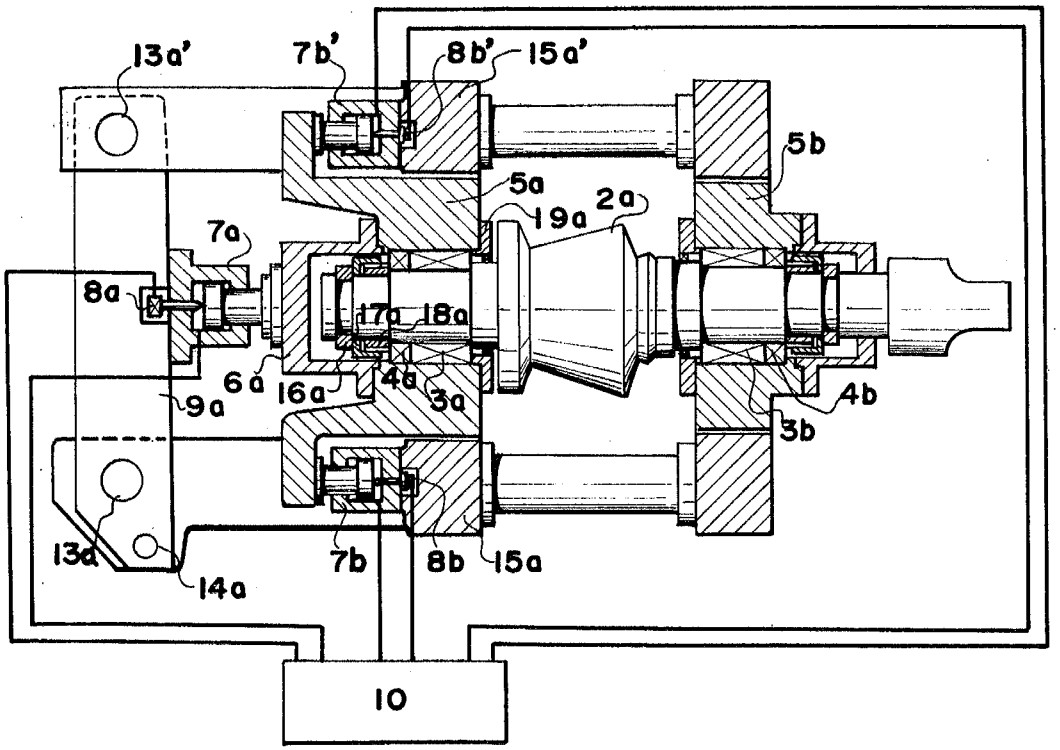

Another embodiment is shown in FIG. 6 in which 2a, 3a, 3b, 4a, 4b, 5a, 5b, 6a, 7a, 8a, 9a and 10 are the same members as those in FIG. 4. In FIG. 6, 7b and 7b' are actuators of output devices for moving the roll 2a in the direction of the roll axis and 8b and 8b' are position detectors for detecting the roll position in the axial direction, 13a and 13a' are rods which connect the frame 9a to housings 15a and 15a'. The rolling thrust is taken up by the housings 15a and 15a' via the roll 2a, the thrust bearing 4a, the bearing box 5a, the end cover 6a, the actuator 7a, the frame 9a, the rods 13a and 13a', or via the roll 2a, a ring 16a, a nut 17a, a hollow bolt 18a, the thrust bearing 4a, the radial bearing 3a, a bearing fastener 19a, the bearing box 5a, and the actuators 7b and 7b'.

The replacement of rolls can be rapidly carried out by turning the frame 9a around a pin 14a after pulling out the rods 13a and 13a' and then removing the roll 2a together with the bearing boxes 5a and 5b to the turn side (the left side of FIG. 6).

Figure 7:
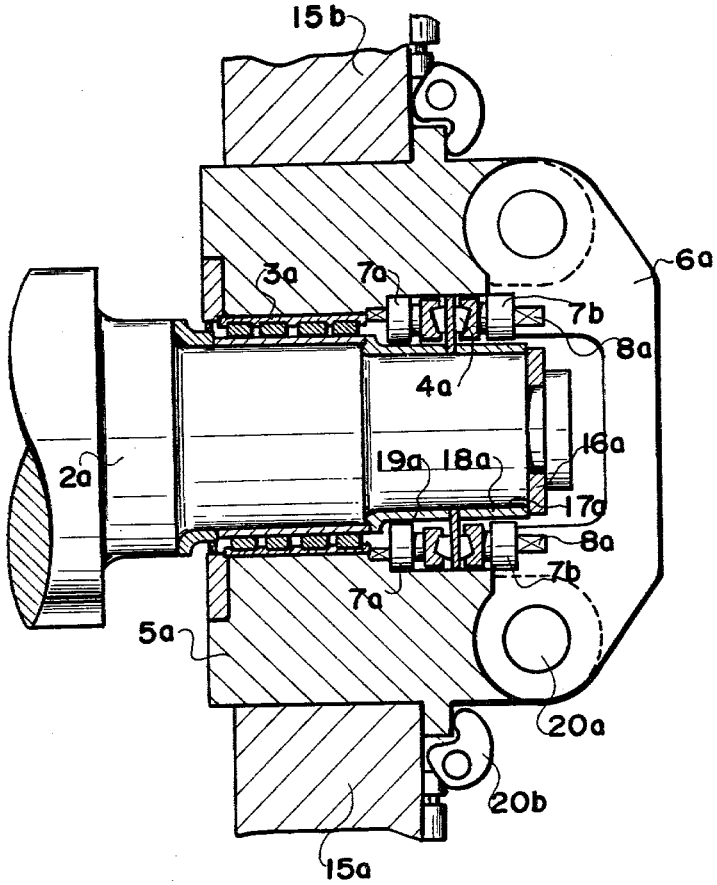
FIG. 7 is a sectional view showing still another preferred embodiment of this invention.

FIG. 7 shows still another embodiment of this invention in which the actuators are housed in a bearing box of the working roll. In FIG. 7, 2a is a roll and 3a is a radial bearing for the roll 2a, 4a being a thrust bearing for the roll 2a, 5a being a bearing box, 6a being an end cover, 7a and 7b being actuators, 8a and 8b being position detectors for detecting the roll position, 15a being a housing, 20a being a pin for connecting the bearing box 5a to the end cover 6a, and 20b being a clamp member for fixing the bearing box 5a to the housing 15a, 16a being a ring, 17a being a nut, 18a being a hollow bolt and 19a being a bearing fastener.

The rolling thrust is taken up by the housings 15a and 15a' via the roll 2a, the bearing fastener 19a, the thrust bearing 4a, the actuator 7b, the end cover 6a, the pin 20a, the bearing box 5a and the clamp member 20b, or via the roll 2a, the ring 16a, the nut 17a, the hollow bolt 18a, the thrust bearing 4a, the actuator 7a and the bearing box 5a.

Figure 8:
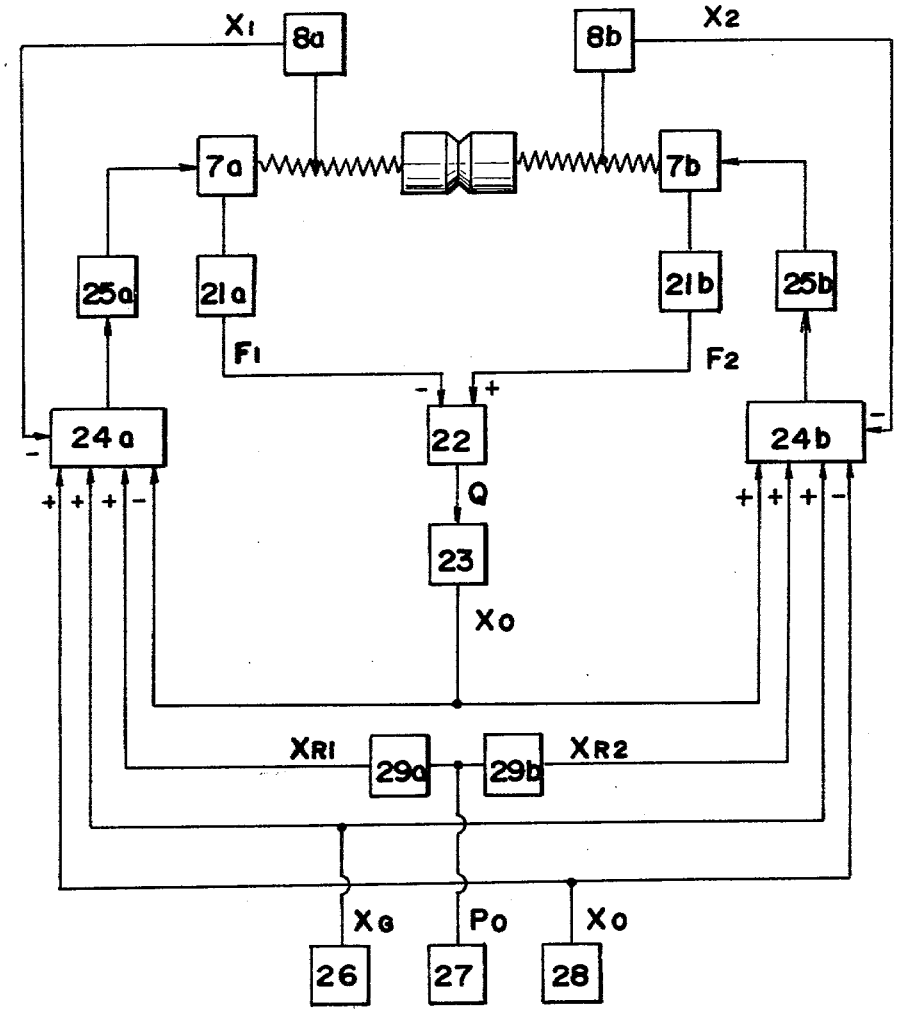
FIG. 8 is block diagram showing a preferred embodiment of this invention.

FIG. 8 is block diagram showing the control system of this invention. FIG. 8 shows the case in which two output devices are employed in this invention. In FIG. 8, 7a and 7b are output devices for moving the roll in the direction of the roll axis and 8a and 8b are position detectors for detecting the roll position in the axial direction ($x_1$, $x_2$), 21a and 21b being output detectors for detecting the output ($F_1$, $F_2$) of the output device 7a and 7b, 22 being a first calculating unit for calculating the rolling thrust Q of the roll, 23 being a second arithmetic unit for calculating the amount of the relative movement of the roll-pass contour of the roll in the axial direction and calculating the amount of the movement ($x_0$) of the roll-pass contour in the axial direction to be given to the output device 7a or 7b for moving the roll-pass contour in the axial direction to the desired position. Operating units 24a and 24b are provided for comparing the outputs of the position detectors 8a and 8b with the output (the desired amount of movement) of the arithmetic unit 23 and processing them, 25a and 25b being output signal generators for operating the output device 7a and 7b. In addition, 26 is a device for removing the initial clearance of the roll in the axial direction ($x_G$) and 27 is a device for setting a preliminary pressure (Po) to be given to the output devices 7a and 7b, 28 being a device for setting the initial position of the roll-pass contour of the roll, 29a and 29b being converters for converting the signal corresponding to the preliminary pressure (Po) to a signal corresponding to the position of the roll in the axial direction ($x_{R1}$, $x_{R2}$). In the embodiment the initial clearance-removing device 26 is provided, but the preliminary pressure-setting device 27 may be used therefor and the device 26 omitted.

The preliminary pressure-setting device 27 supplies a signal for setting the preliminary load (Po) to the output devices 7a and 7b and simultaneously therewith the initial roll-pass contour position-setting device 28 supplies a signal for setting the roll-pass contour to the initial position, which is an initial setting condition. The desired amount of movement of the roll in the axial direction to be supplied to the output devices 7a and 7b is calculated by the second arithmetic unit 23 from (1) the formula relating to the rolling thrust force (Q) for the amount of movement of the roll-pass contour in the axial direction under the condition that the position detected by the position-detectors 8a and 8b is kept constant and (2) the rolling thrust force (Q) obtained by the first calculating unit 22 from the initial set values and the outputs of the output-detectors 21*a* and 21*b*, etc. At the same time, the output devices 7*a* and 7*b* are operated and controlled by the operating units 24*a* and 24*b* and the output signal generators 25*a* and 25*b* such that the interval between the positions detected by the position detectors 8*a* and 8*b* is kept constant, namely the detected positions are moved the same amount and in the same direction, while the aimed desired amount of movement calculated is compared with the outputs of the axial roll-position detectors 8*a* and 8*b*, whereby the positions of the detecting portions of the detectors 8*a* and 8*b* in the axial direction is caused to correspond to the desired positions, that is, the position of the roll-pass contour in the axial direction is moved to the desired position.

The control principle of this invention will now be described in connection with the models shown in FIGS. 9 and 10.

Figure 9:
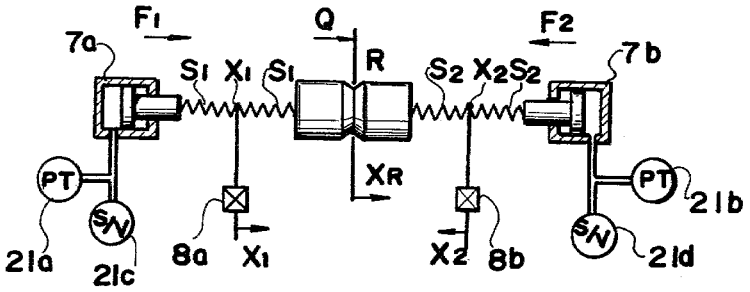
FIGS. 9 and 10 are models for explaining the principles of the controls of the embodiments of this invention.
Figure 10:
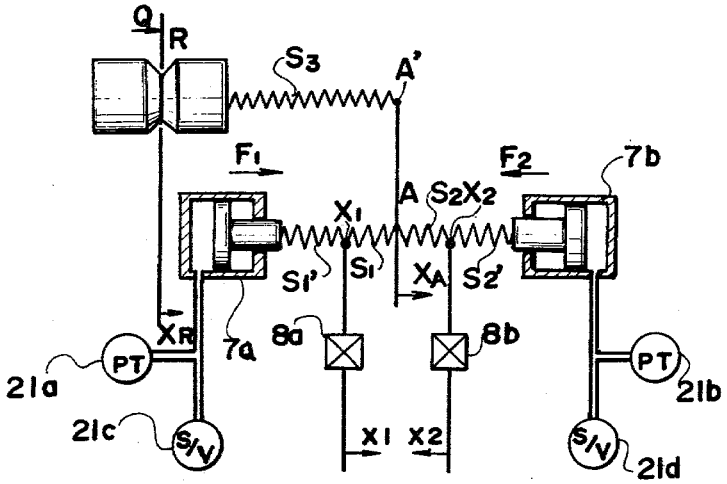

FIG. 9 shows a model in which the output devices 7*a* and 7*b* are arranged at opposite ends of the position of the roll-pass contour of the roll, FIG. 10 shows a model in which they are arranged at the same end. In FIGS. 9 to 10 the springs of the respective members of the axial-adjusting mechanism of an actual rolling mill consisting of a roll, bearings for the roll, bearing boxes and an axial adjusting device are integrally represented by symbols $S_1$, $S_2$, $S_3$, $S_{1'}$ and $S_{2'}$.

In FIGS. 9 and 10, 7*a* and 7*b* are output devices for applying to the roll forces up the axial direction which are opposed to each other, which devices are shown as being liquid pressure cylinders, and 8*a* and 8*b* are position-detectors for detecting the position of the roll in the axial direction, 21*a* and 21*b* being output detectors, which detectors are shown as being liquid-pressure detecting devices, 21*c* and 21*d* being control devices for controlling the output devices 7*a* and 7*b* by the output signal, and which are shown as being servo valves. The symbols $X_1$ and $X_2$ show the positions of the detecting terminals of the detectors 8*a* and 8*b* and the symbols $S_1$, $S_2$, $S_3$, $S_1'$ and $S_2'$ are the springs of the respective members of the axial adjusting mechanism, Po being the forces preliminarily imparted by the output devices 7*a* and 7*b* (initial values), Q being the rolling thrust force imparted to the roll, $F_1$ and $F_2$ being the output loads applied from the respective output devices 7*a* and 7*b*, R being the position of the roll-pass contour of the roll, A and A' being the points showing the boundary between the portion to which the force Po is applied and the portion to which force Po is not applied, i.e., the force Po is applied to the output device side from the points A-A' and is not applied to roll side from the points A-A', $x_1$ and $x_2$ being the positions of the axial direction of the $X_1$ and $X_2$, respectively, $x_R$ and $x_A$ being the positions in the axial direction of the respective P point and A point (A' point), the initial setting points of which are zero points. In addition, $x_{1.0}$ and $x_{2.0}$ are the values of $x_1$ and $x_2$ under the initial condition in which Po is imparted to the output devices 7*a* and 7*b*. In FIGS. 9 and 10 the values of $x_1$, $x_2$, $x_A$, $x_R$, $F_1$, $F_2$ and/or Q, etc. are plus when the directions are the same as those of the arrows shown therein.

The following description is directed to FIG. 9.

It is assumed that, when the positions $X_1$ and $X_2$ are set under the conditions that Po=0 and that the initial clearance is zero, the relation between the thrust force Q and $X_R$ is shown by the following equation (1) or (2).

$$Q=f(x_R) \tag{1}$$

or $$x_R=g(Q) \tag{2}$$

When the preliminary pressure Po (Po>0) is given to the roll in the direction of the roll axis by the output devices 7*a* and 7*b* so as to make $x_R=0$, the following equation (3) can be obtained.

$$\left.\begin{array}{l} F_1 - F_2 = Po \\ x_1 = x_{1.0},\ x_2 = x_{2.0} \end{array}\right\} \tag{3}$$

When the positions of $X_1$ and $X_2$ are set, that is, $X_1$, $X_2$ are maintained so as to meet the equation (3), the following equation (4) or (5) showing the relation between Q and $x_R$ is obtained from the equation (1) or (2) and the characteristic of the preliminary pressure spring as follows:

$$Q=F(x_R,Po) \tag{4}$$

or $$x_R=G(Q,\ Po) \tag{5}$$

In this connection, the function $F(x_R, Po)$ of the equation (4) is a function defined by the following equation and equation (5) is a function positively representing the equation (4) regarding $x_R$.

$$F(x_R,\ Po)=f(x_R+x_R^1) \text{ for } x_R>-x_R^2 \tag{6$_1$}$$

$$=f(x_R+x_R^1)+f(x_R+x_R^2) \text{ for } -x_R^2 \geqq x_R \geqq x_R \geqq -x_R^1 \tag{6$_2$}$$

$$=f(x_R,\ x_R^2) \text{ for } -x_R^1<x_R \tag{6$_3$}$$

in which $$\left.\begin{array}{l} x_R^1 = g(Po) \\ x_R^2 = g(-Po) \end{array}\right\} \tag{7}$$

Next, the conditions of equation (3) are ended and the control is carried out to satisfy the following equations (8).

$$\left.\begin{array}{l} x_1 = x_{1.0} - x_o \\ x_2 = x_{2.0} + x_o \end{array}\right\} \tag{8}$$

From the above equations (8) it is noted that $x_1+x_2=x_{1.0}+x_{2.0}$=constant. Consequently, the relation between Q and $x_R$ can be represented by the following equation (9) or (10) in which $x_R$ of the equation (4) or (5) is replaced by $x_R+x_o$.

$$Q=F(x_R+x_o,\ Po) \tag{9}$$

or $$x_R+x_o=G(Q,\ Po) \tag{10}$$

In addition, the apparent mill rigidity K in the direction of the roll axis is defined by the following equation (11).

$$Q=K\cdot x_R \tag{11}$$

When the relation of the equation (11) is applied to the equation (10), the following equation (12) can be obtained.

$$x_o = U(Q, Po, K) \text{ in which}$$

$$U(Q, Po, K) = G(Q, Po) - Q/K \tag{12}$$

When equation (12) is inserted in equation (8), the following equation (13) can be obtained.

$$\left.\begin{aligned} x_1 &= x_{1.0} - U(Q, Po, K) \\ x_2 &= x_{2.0} + U)Q, Po, K) \end{aligned}\right\} \tag{13}$$

That is, the desired axial mill rigidity K can be obtained by controlling $x_1$ and $x_2$ so as to satisfy the equations (13).

Figure 11:
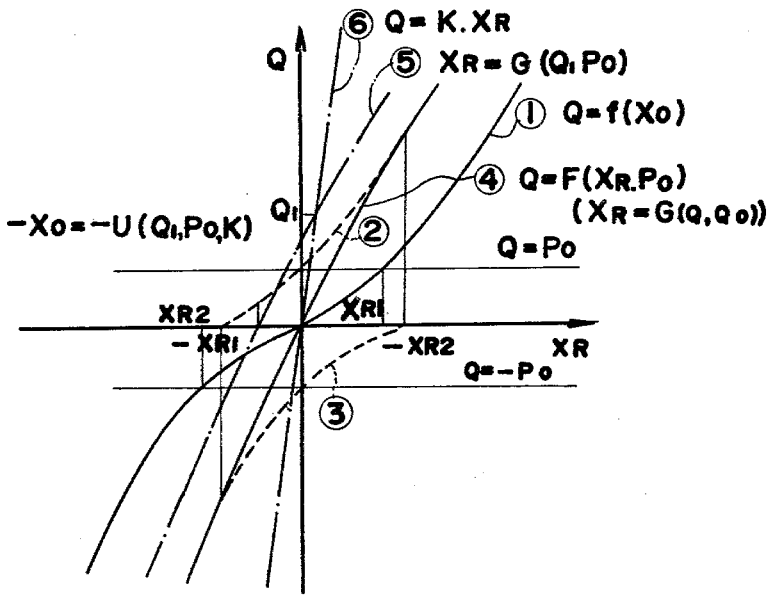
FIGS. 11 and 12 are graphs for explaining the equations relative to the controls of the embodiments of this invention.

FIG. 11 is a graph showing the above relations wherein the curve ① is for the equation (1) or (2) and the curve ② shows the portion Q=0 of the curve ① moved in parallel to the left by an amount of $x_{R1}$, the curve ③ showing the portion Q=0 of the curve ① moved in parallel to the right by an amount of $-x_{R2}$, the curve ④ being the combined curve of the curves ② and ③ and being for the equation (4) or (5), the curve ⑤ being the curve ④ moved in parallel to the left by an amount of $\alpha_o$ and being for the equation (9) or (10), the curve ⑥ being the curve obtained by the control of the equation (13) and being for the equation (11).

The model shown in FIG. 10 is described in detail below.

It is pressumed that, when the positions $X_1$ and $X_2$ are fixed under the conditions that Po=0 and that the initial clearance is zero, the relation between the thrust force Q and $x_A$ is given by the following equation (14) or (15).

$$Q = f'(x_A) \tag{14}$$

or $$x_A = g'(Q) \tag{15}$$

When the preliminary pressure Po (Po>0) is applied to the roll in the direction of the roll axis by the output devices *7a* and *7b* so as to make $x_R=0$, the following equation (16) can be obtained.

$$\left.\begin{aligned} F_1 = F_2 &= Po, x_A = 0 \\ x_1 = x_{1.0}, x_2 &= x_{2.0} \end{aligned}\right\} \tag{16}$$

When the $X_1$ and $X_2$ points are set to satisfy the equation (16), the following equation (17) or (18) can be obtained from the equation (14) or (15) and the characteristic of the preliminary pressure spring.

$$\left.\begin{aligned} Q &= F'(x_A, Po) \\ \text{or } x_A &= G'(Q, Po) \end{aligned}\right\} \begin{matrix}(17)\\(18)\end{matrix}$$

In this connection, the equation (17) is the function defined by the following equation and the equation (18) is the function positively representing the equation (17) for $x_A$.

$$F'(x_A, Po) = f(x_A + x_{A1}) \text{ for } x_A > -x_{A2} \tag{19$_1$}$$

$$= f(x_A + x_{A1}) + f(x_A + x_{A2}) \text{ for } -x_{A2} \geqq x_A \geqq x_{A1} \tag{19$_2$}$$

$$= f(x_A + x_{A2}) \text{ for } -x_{A1} > x_A \tag{19$_3$}$$

in which $$\left.\begin{aligned} x_{A1} &= g'(Po) \\ x_{A2} &= g'(-Po) \end{aligned}\right\} \tag{20}$$

In addition, when the characteristics of the spring $S_3$ are defined by the following equation (21) or (22)

$$Q = f'(x_R - x_A) \tag{21}$$

or $$x_R - x_A = g''(Q) \tag{22}$$

and the equation (18) is inserted in the equation (22), the following equation (23) can be obtained.

$$x_R = G'(Q, Po) + g''(Q) \tag{23}$$

When the right side of the equation (23) is represented by G*(Q, Po), the following equation (23)' can be obtained.

$$x_R = G^*(Q, Po) = G'(Q, Po) + g''(Q) \tag{23'}$$

The equation (23)' is the same type of function as and the curve has the same shape as the equation (5) for the model shown in FIG. 9. Accordingly, the equations (8) to (13) regarding FIG. 9 can also be applied to the model of FIG. 10 by using G*(Q, Po) instead of G(Q, Po). That is, if $$U^*(Q, Po, K) = G^*(Q, Po) - Q/K \tag{24}$$

the desired axial mill rigidity K can be obtained by controlling $x_1$ and $x_2$ so as to satisfy the following equations (25).

$$\left.\begin{aligned} x_1 &= x_{1.0} - U^*(Q, Po, K) \\ x_2 &= x_{2.0} + U^*(Q, Po, K) \end{aligned}\right\} \tag{25}$$

Figure 12:
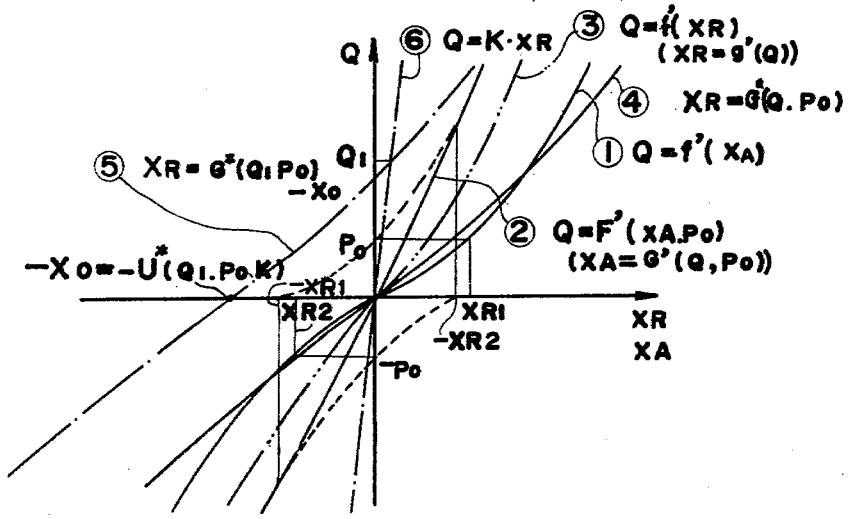

FIG. 12 is a graph showing the above relations in which the curve ① is for the equation (14) or (15) and the curve ② is for the equation (17) or (18), the curve ③ is for the equation (21) or (22) in $x_A=0$, the curve ④ being the combined curve of the curves ② and ③ and being for the equation (23), the curve ⑤ being the curve ④ moved in parallel to the left by an amount of $x_o$ and being for the equation wherein the G(Q, Po) of the equation (10) is replaced by G*(Q, Po), the curve ⑥ being for the equation (11) obtained by the control of the equation (25).

As the simplest example of FIG. 9, for instance, when the function $f(x_R)$ of the equation (1) is given by the proportional expression of the $x_R$, that is $$\begin{aligned} f(x_R) &= k_1 \cdot x_R : x_R = 0 \\ &= k_2 \cdot x_R : x_R < 0 \end{aligned}$$

the following equations can be obtained as the equation (13).

$$\left.\begin{aligned} &Q > (1 + \frac{k_1}{k_2})Po \\ &x_1 = x_{1.0} - (\frac{1}{k_1} - \frac{1}{K})Q + \frac{Po}{k_1} \\ &x_2 = x_{2.0} + (\frac{1}{k_1} - \frac{1}{K})Q + \frac{Po}{k_1} \end{aligned}\right\} \quad (13)_1$$

$$\left.\begin{aligned} &(1 + k_1/k_2)Po \geqq Q \geqq -(1 + k_2/k_1)Po \\ &x_1 = x_{1.0} - (\frac{1}{k_1 + k_2} - \frac{1}{K})Q \\ &x_2 = x_{2.0} + (\frac{1}{k_1 + k_2} + \frac{1}{K})Q \end{aligned}\right\} \quad (13)_2$$

$$\left.\begin{aligned} &-(1 + k_2/k_1)Po > Q \\ &x_1 = x_{1.0} - (\frac{1}{k_2} - \frac{1}{K})Q - \frac{Po}{k_2} \\ &x_2 = x_{2.0} + (\frac{1}{k_2} - \frac{1}{K})Q - \frac{Po}{k_2} \end{aligned}\right\} \quad (13)_3$$

As set forth above, the desired mill rigidity in the axial direction of the roll can be achieved by conducting the control in accordance with the respective equations $(13)_1$, $(13)_2$, and $(13)_3$ responding to the range of Q. However, when the range of Q is known, the equations $(13)_1$, $(13)_2$ and $(13)_3$ can be limited to any one of them by selecting a proper value of Po so as to simplify the control unit. On the other hand, the thrust force Q must be obtained by the equation (13) or (25). It is generally considered that the thrust force Q depends upon not only the outputs $F_1$ and $F_2$ of the output devices *7a* and *7b* but also the radial load Pr (which is generally called the rolling load), dQ/dt, i.e., change of Q in relation to time, and the coefficient of friction $\mu$, because friction affects the value of the thrust force Q. That is, the force Q can be represented by the following equation (26).

$$Q = Q(F_1, F_2, Pr, dQ/dt, \mu) \quad (26)$$

If the coefficient of friction $\mu$ and the dQ/dt are very small and they can be disregarded in equation (26), Q can simply be represented by the following equation (26)'

$$Q = F_1 - F_2 \quad (26)'$$

In the models shown in FIGS. 9 and 10 each of the springs $S_1$ and $S_2$ is constituted so as to act as a compression spring but it may be constituted to function as a tension spring. In such case, the equation (13) or (25) can be obtained in the same manner as for the model of FIG. 9 or 10 by defining the reverse direction of the arrow of each of $x_1$, $x_2$, $x_A$, $x_R$, $F_1$, $F_2$ and Q as plus so that the desired mill rigidity in the axial direction K can be achieved by conducting the control to meet the equation (13) or (25) by the use of the equation (26).

In addition, the above explanations are directed to a control system based upon the condition that the rolling thrust force is zero but the system may be constituted so as to estimate the rolling thrust force Qpre which will occur, to conduct the initial setting such that the position of the axial direction of the roll-pass contour satisfies the aimed value regarding the Qpre estimated, and thereby to carry out the control to the amount of the deviation between the actual rolling thrust force and the estimated rolling thrust force. Furthermore, in FIG. 8 the inputs of the first calculating unit 22 are only the outputs $F_1$ and $F_2$ of the output detectors 21*a* and 21*b* but the calculating unit 22 can be constituted such that the radial load Pr is also introduced therein as well as the outputs $F_1$ and $F_2$ and the rolling thrust can be obtained in accordance with the equation (26). The second arithmetic unit 23 can also be constituted so as to accept information concerning the position of the roll-pass contour in the axial direction or information about the axial positions of the roll-pass contours of the opposed rolls thereinto to calculate the desired axial mill rigidity K from such information and, thereby, to calculate the desired amount of movement of the roll in the axial direction.

As described above, according to this invention it is possible to control the position the roll-pass contour in the axial direction, which has been impossible in the prior art, and it is also possible to conduct the rolling without deviation of the mutual position of the roll-pass contours of the upper and lower rolls, which makes it possible to produce section shaped elements having fewer deviations of the sectional thickness from the desired thickness. In addition, according to this invention a rolling mill capable of optionally changing its apparent mill rigidity of in the direction of the roll axis can be provided whereby it is made possible to produce section shaped elements having fewer bends.

Of course, it should be understood that the accompanying drawings and the explanations thereof are only examples of this invention and this invention can be modified or changed variously within the scope of the claims.

We claim:

1. An apparatus for controlling the position of at least one roll of a rolling mill in the direction of the roll axis for achieving a desired rolling thrust force in the axial direction, said rolling mill having bearing boxes supporting the roll and a rolling mill housing, said apparatus comprising at least two output means acting on said roll, one for moving the roll in one direction along the roll axis and the other for moving the roll in the opposite direction along the roll axis, output detecting means connected to said output means for detecting the output loads of the respective output means, position detecting means operatively connected with said roll for detecting the position of the roll in the direction of the roll axis, a first arithmetic means connected to said output detecting means for calculating the rolling thrust force in the axial direction of the roll from said detected output loads, a second arithmetic means connected to said first arithmetic means and said position detecting means for receiving inputs therefrom and for calculating the amount of movement of the roll necessary for achieving a desired rolling thrust force in the axial direction and connected to said output means for controlling the output means for moving the roll the desired amount.

2. An apparatus as claimed in claim 1 in which each output means includes an actuator in the corresponding bearing box for the roll.

3. An apparatus as claimed in claim 1 in which each output means includes an actuator between the corresponding bearing box and the housing of the rolling mill.

4. An apparatus as claimed in claim 1 in which each output means includes an actuator and a support member therefor positioned adjacent the roll.

5. An apparatus as claimed in claims 2, 3 or 4 in which said actuator is a fluid pressure actuated piston-cylinder means.

6. An apparatus as claimed in claims 2, 3 or 4 in which said actuator is a pair of complementary wedges and a fluid pressure actuated piston-cylinder means attached to one of said wedges for moving it relative to the other.

* * * * *